United States Patent [19]

Wang

[11] Patent Number: 4,814,599

[45] Date of Patent: Mar. 21, 1989

[54] MICROCHANNEL PLATE STREAK CAMERA

[75] Inventor: Ching L. Wang, Livermore, Calif.

[73] Assignee: The United States of America as represented by the United States Department of Energy, Washington, D.C.

[21] Appl. No.: 83,014

[22] Filed: Aug. 6, 1987

Related U.S. Application Data

[63] Continuation of Ser. No. 655,499, Sep. 28, 1984, abandoned.

[51] Int. Cl.[4] ..... H01J 31/50

[52] U.S. Cl. ..... 250/213 VT; 313/103 CM

[58] Field of Search ..... 313/103 CM, 105 CM, 313/524, 534; 250/213 UT, 207; 358/111; 378/99

[56] References Cited

U.S. PATENT DOCUMENTS

| | | | |
|---|---|---|---|
| 4,120,002 | 10/1978 | Lieber | 358/111 |
| 4,304,998 | 12/1981 | Cushman | 250/213 VT |
| 4,327,285 | 4/1982 | Bradley | 250/213 VT |
| 4,471,378 | 9/1984 | Ng | 358/111 |

OTHER PUBLICATIONS

Parkes et al., "Soft X-ray Studies of Channel Multipliers and Multiplier Arrays", IEEE Trans. Nucl. Sci. Ns 17, 1970 pp. 360–366.

Dolan et al, "Microchannel Plate Response to Hard X-rays" SPIE vol. 106, X-ray Imaging (1977), pp. 178–188.

Adams et al., "Detection Efficiency of Channel Plates to X-rays", ACTA Electronica, vol. 14, No. 2, 1971 p. 237–244.

Gex, et al., "SI Photocathode Designed for Streak Camera Image Converter Tubes", Rev. Sci. Instrum., 54(2), Feb. 1983.

UCRL-90393 Rev. 1 "A Micro Channel Plate Streak Camera", C. L. Wang et al.

*Primary Examiner*—David C. Nelms

*Attorney, Agent, or Firm*—L. E. Carnahan; Roger S. Gaither; Judson R. Hightower

[57] ABSTRACT

An improved streak camera in which a microchannel plate electron multiplier is used in place of or in combination with the photocathode used in prior streak cameras. The improved streak camera is far more sensitive to photons (UV to gamma-rays) than the conventional x-ray streak camera which uses a photocathode. The improved streak camera offers gamma-ray detection with high temporal resolution. It also offers low-energy x-ray detection without attenuation inside the cathode. Using the microchannel plate in the improved camera has resulted in a time resolution of about 150 ps, and has provided a sensitivity sufficient for 1000 KeV x-rays.

6 Claims, 3 Drawing Sheets

MICROCHANNEL PLATE STREAK CAMERA

BACKGROUND OF THE INVENTION

The invention described herein arose at the Lawrence Livermore National Laboratory in the course of, or under, Contract No. W-7405-ENG-48, awarded the University of California by the U.S. Department of Energy.

This application is a continuation of Ser. No. 655,499 filed Sept. 28, 1984, now abandoned.

The invention relates to optical or x-ray streak cameras, particularly to an improved streak camera which significantly improves the sensitivity, and more particularly to a streak camera which utilizes a microchannel plate electron multiplier instead of a photocathode.

The importance and desirability of performing time-resolved hot or superhot x-ray measurement in laser fusion experiments has long been recognized. Unfortunately, however, there is no established technique available for x-ray measurement above 30 KeV. The conventionally known x-ray streak cameras are not sensitive enough for such high energy x-rays. This is because they utilize a photocathode and the sensitivity of the photocathode decreases rapidly at high energies. Thus, a need has existed in the art for a technique for the measurement of high energy x-rays.

Therefore, it is an object of this invention to provide an improved streak camera.

Another object of the invention is to modify a conventional x-ray streak camera by replacing the photocathode with a microchannel plate.

A still further object of the invention is to provide a streak camera that is more sensitive to photons (ultraviolet to gamma-rays) than conventional x-ray streak cameras.

Another object of the invention is to provide an x-ray streak camera capable of x-ray measurement above 30 KeV.

Another object of the invention is to provide an x-ray streak camera having a time resolution of about 100–200 ps.

Another object of the invention is to provide a streak camera which utilizes a microchannel plate electron multiplier in place of a photocathode.

Other objects of the invention will become readily apparent to those skilled in the art from the following description and accompanying drawings.

SUMMARY OF THE INVENTION

The objects of the invention are carried out by providing an improved streak camera which is much more sensitive to high energy x-rays and gamma-rays, as well as to low energy x-ray applications and to charged particles. This is accomplished by utilizing a microchannel plate (MCP) electron multiplier in place of the photocathode utilized in prior known streak cameras. The invention provides for x-ray measurements above 30 KeV with a time resolution of about 100–200 ps. Also, since the MCP transmits secondary electrons from the front surface to the rear, it is ideal for detecting low energy x-rays incident at large angle to the normal to the cathode.

DETAIIED DESCRIPTION OF THE INVENTION

The invention is directed to an improved steak camera that is far more sensitive to UV-gamma rays than the conventional known x-ray streak cameras. In carrying out the present invention, the photocathode of the conventional x-ray streak camera is replaced with a microchannel plate (MCP) electron multiplier. The mere replacement of the photocathode with an MCP enables x-ray measurement above 30 KeV which could not be accomplished with a streak camera using a photocathode, while having low-energy x-ray and charged particle applications.

Figure 1:
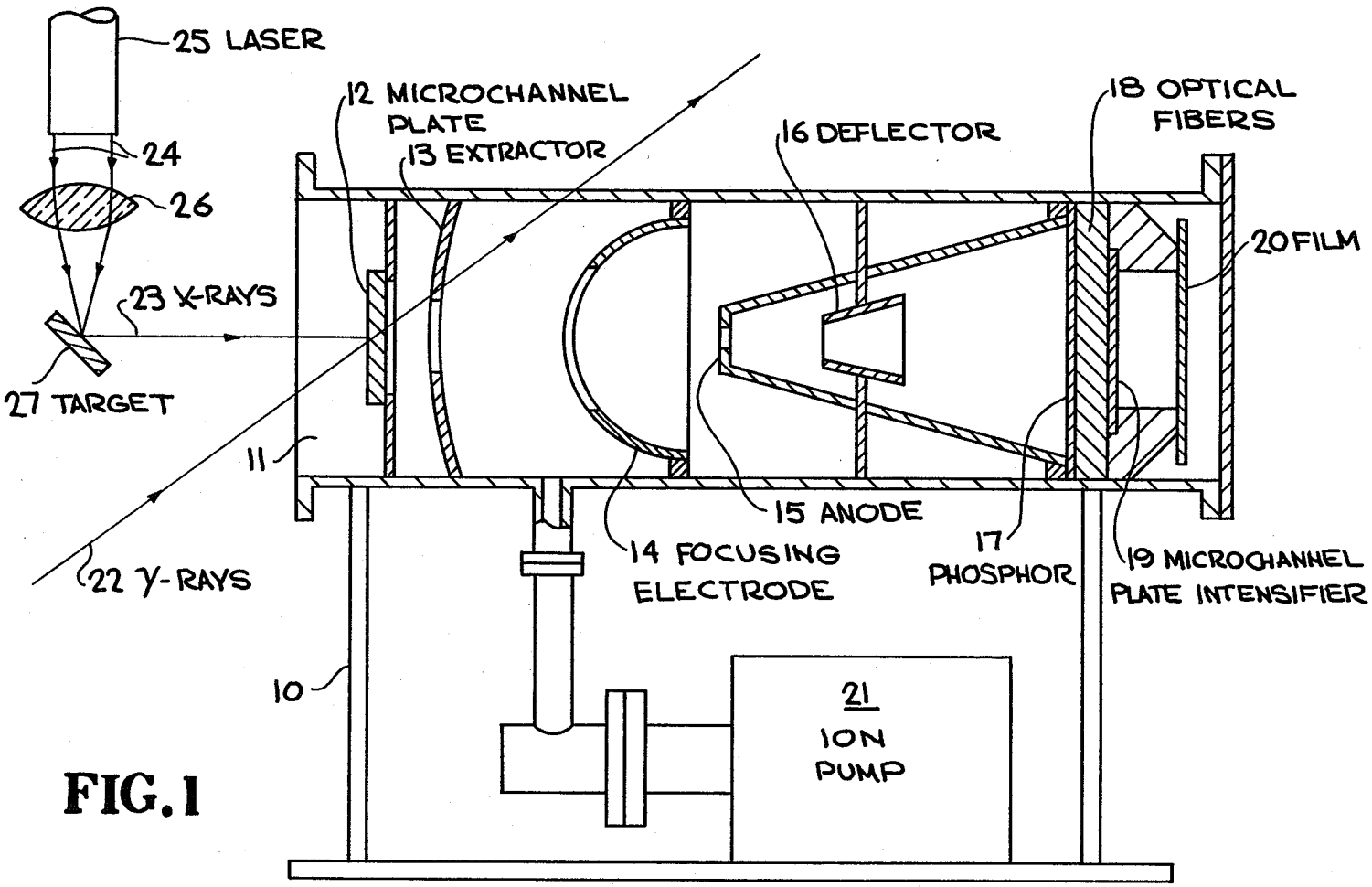
FIG. 1 schematically illustrates an embodiment of the improved streak camera made in accordance with the invention.

Referring now to FIG. 1, an embodiment of an improved streak camera made in accordance with the invention is schematically illustrated, but with portions broken away for clarity. The streak camera of FIG. 1 is similar to a conventional x-ray streak camera except that the photocathode of the conventional camera is replaced by a microchannel plate electron multiplier. In FIG. 1 embodiment comprises a housing 10 having an opening 11 in which is mounted a microchannel plate 12 (in place of a photocathode), an extractor 13, a focusing electrode 14, an anode 15, a deflector 16, phosphor 17, optical fibers 18, a microchannel plate intensifier 19, and film 20. An ion pump 21 is connected to the opening 11 adjacent focusing electrode 14.

During operation, gamma-rays from a source 22 are directed onto the microchannel plate 12, or x-rays, indicated at 23, generated by energy, indicated at 24, from a laser 25 directed through a lens 26 onto a target 27, is directed onto the microchannel plate 12 of the streak camera.

Figure 2:
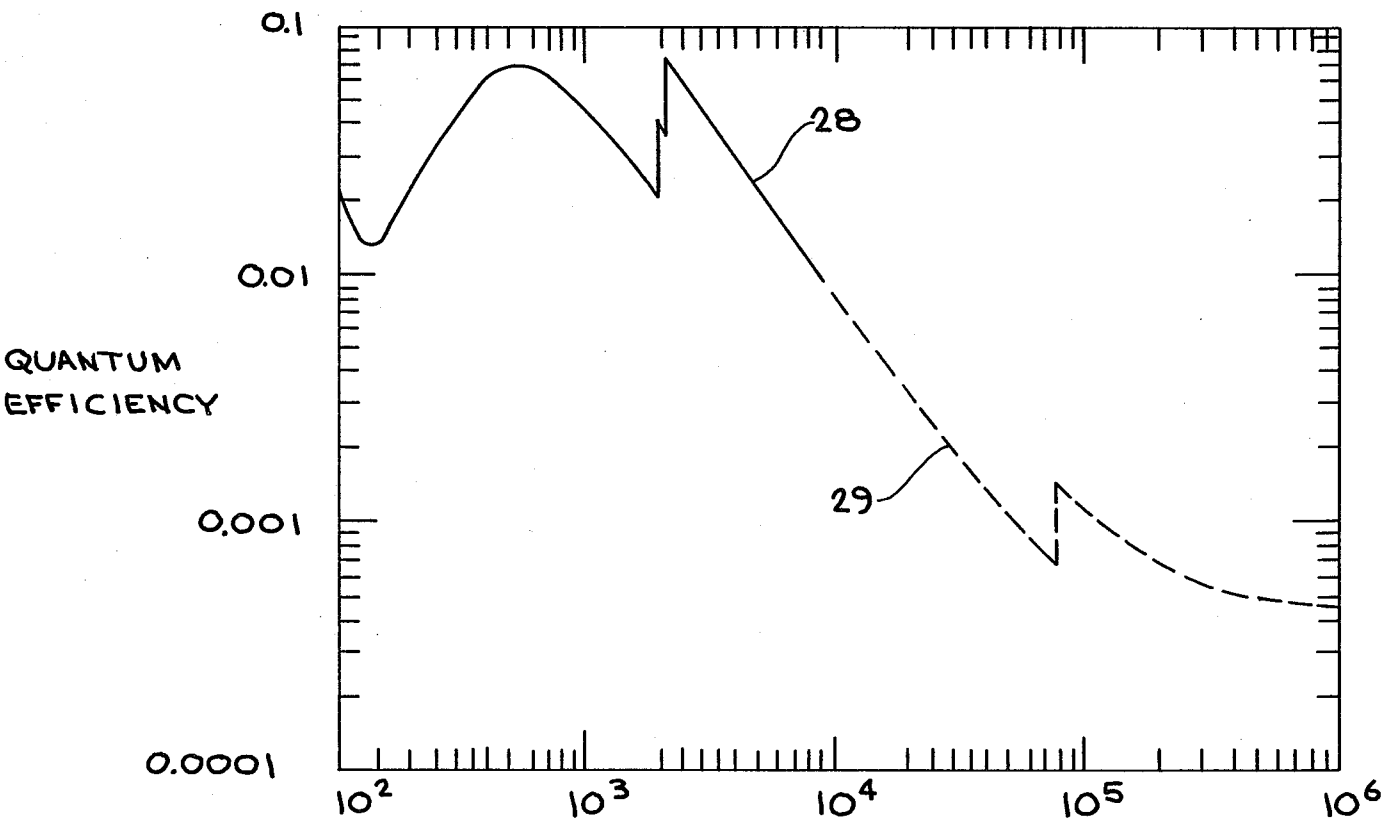
FIG. 2 is a graph showing the back-surface secondary electron quantum yield of a 230Å gold transmission photocathode with an extrapolation based on existing data.
Figure 3:
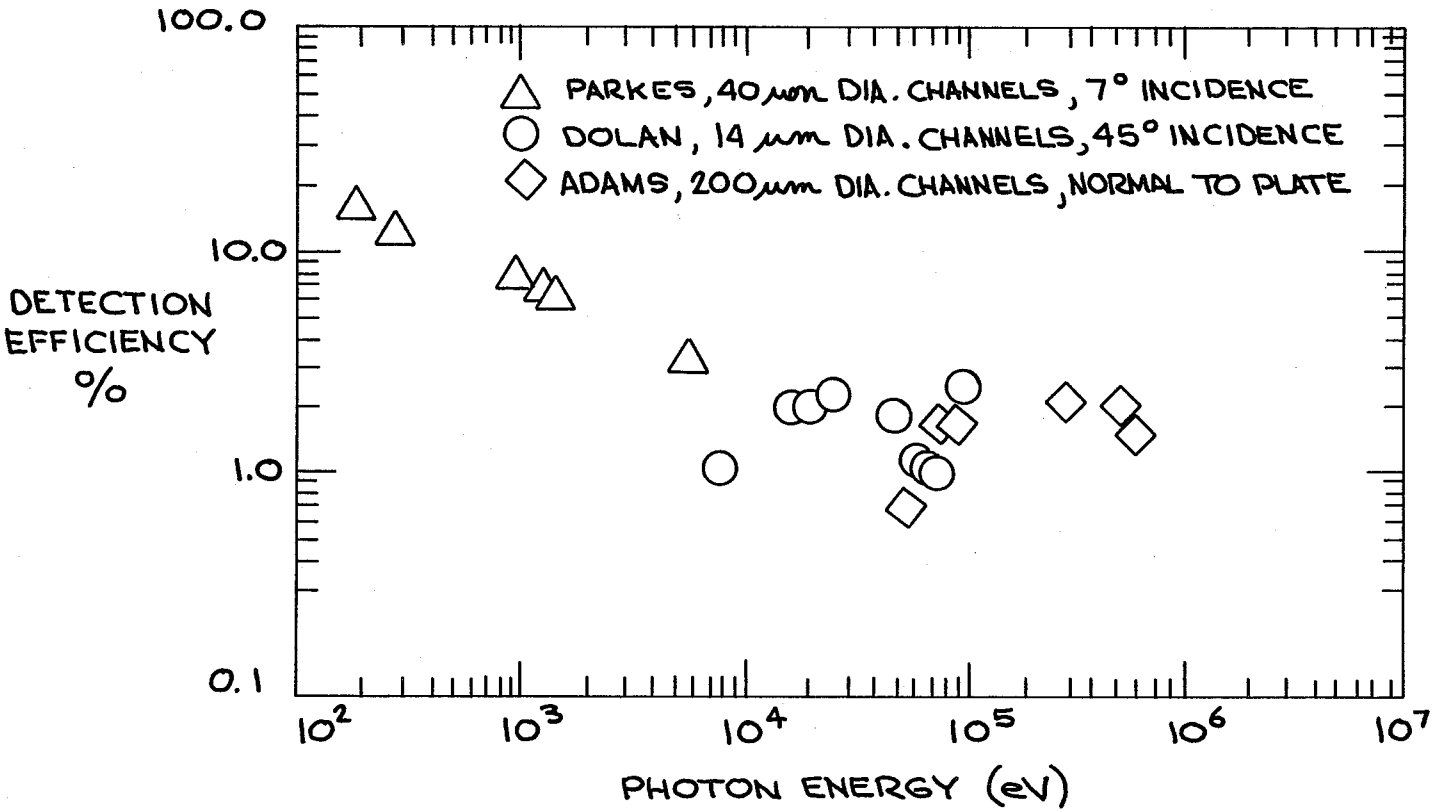
FIG. 3 is a graph showing a compilation of microchannel plate efficiencies.

FIGS. 2 and 3 illustrate the reason why the improved streak camera arrangement of FIG. 1 can provide higher sensitivity compared to a similar camera using a photocathode. FIG. 2 is shown by solid line 28 the back-surface secondary electron quantom yield for a 230Å gold (Au) transmission photo-cathode, as per data by Henke et al, J. Appl. Phys. 52, 1509, 1981; while an extrapolation is shown by dashed line 29, using normalized front-surface data from Slivinsky et al, unpublished report UOPE 70-7, Univ. of Calif. Lawrence Livermore Laboratory, 1970. In the limit where the streak camera is sensitive to a single electron, the quantum efficiency can be equaled to the detection efficiency of FIG. 3 and is a compilation of the detection efficiency of the microchannel plate for 0.1–1000 KeV photons. Data for FIG. 3 is taken from Parkes et al, IEEE Trans. Nucl. Sci. NS-17, 360, 1970; K. W. Dolan et al, SPIE 106, 178, 1977; and J. Adams et al, Electronica, 14, 237, 1971. The microchannel plate retains its 1% efficiency for gamma-like photon energies, and offers gamm-ray detection with high temporal resolution, as well as for x-ray applications.

Comparing the microchannel plate (MCP) streak camera with a conventional photocathode streak camera, (XSC), it has been shown that the detection efficiency of the MCP version is 1% (FIG. 3) for MeV photons, while that of the XSC is 0.005%, since the quantum efficiency of a gold photocathode for MeV photons is 0.05% (FIG. 2) and nominally 10 photoelectrons are required for a detectable streak trace on the film 20 (FIG. 1). Thus, the increase in the streak camera sensitivity for gamma-rays due to the MCP, instead of the photocathode, is ≧200.

Based on test conducted using the microchannel plate electron multiplier, the invention has applications in high energy and low energy x-ray detection, the time resolution being estimated to be less than 150 ps. These tests are described in greater detail in UCRL-90393 Rev. 1 entitled "A Microchannel Plate Streak Camera", C. L. Wang et al, prepared for presentation at the 16th International Congress On High Speed Photography and Photonics, Strasbourg, France, Aug. 27–31, 1984.

Based on test data an x-ray streak camera with a microchannel plate electron multiplier is sensitive enough for 100 KeV x-rays from targets of interest, with a time resolution expected to be 40–70 ps.

Table I gives the number of photons incident on a 0.1 mm X 5 mm slit of an MCP-streak camera at 1m from the target irradiated with the Novette Laser System located at the Lawrence Livermore National Laboratory.

The MCP-streak camera of this invention will have applications in: (1) measuring the x-ray production time, (2) x-ray laser experiments, (3) time-resolved suprathermal x-ray measurements in laser fusion research, (4) detecting low energy x-rays, and (5) detecting charged particles.

While tests have not yet been conducted to verify a modification of the illustrated embodiment of the MCP-streak camera involving placing an optical photocathode in front of the microchannel plate, it is anticipated that such a modification will result in a streak camera which is sensitive to optical light as well as to hot/superhot x-rays.

It has thus been shown that the improved streak camera of this invention is sensitive enough for high energy (100 KeV) x-rays, as well as being sensitive to gamma-rays, low energy x-rays and charged particles. Thus, the MCP-streak camera of this invention is far more sensitive to photons (UV to gamms-rays) than the conventional photocathode streak camera.

While a particular embodiment of the invention has been illustrated and described, modifications will become apparent to those skilled in the art, and it is intended to cover in the appended claims all modifications that come with the scope of this invention.

What is claimed is:

1. A method for increasing the sensitivity of a streak camera containing a photocathode sensitive to photons in the ultra-violet to gamma-ray range,
comprising the step of:
substituting a microchannel plate electron multiplier for the photocathode in said camera for receiving x-rays and gamma-rays from a source.

2. An instrument sensitive enough for measuring x-rays having an energy of at least 100 KeV comprising:
a housing having an opening therein,
a microchannel plate positioned in said opening of said housing,
an extractor positioned in said opening and adjacent said microchannel plate,
a focusing the electrode positioned in said opening and adjacent said extractor,
an anode positioned in said opening and adjacent said focusing electrode,
a deflector positioned in said opening and adjacent said anode,
a phospher plate positioned in said opening and adjacent said deflector,
optical fibers located in said opening and adjacent said phospher plate,
a microchannel plate intensifier located in said opening and adjacent said optical fibers,
a film positioned in said opening and adjacent said intensifier, and
an ion pump operatively connected to said opening of said housing at a point intermediate said extractor and said focusing electrode.

3. The instrument of claim 2 in combination with means for directing laser energy onto a target thereby producing x-rays which are directed onto said microchannel plate.

4. The instrument of claim 2 in combination with means for directing gamma-rays onto said microchannel plate.

5. A method of increasing the sensitivity of a conventional streak camera using a photocathode for measuring photons in the ultra-violet to gamma-ray range, comprising the steps of:
removing the photocathode, and
installing a microchannel plate electron multiplier in place of the photocathode, thereby increasing the sensitivity of the camera so as to have the capability of measuring x-rays having an energy of at least 100 KeV.

6. The method of claim 5, additionally including the step of positioning a photocathode in front of adjacent to the microchannel plate, whereby the camera is sensitive to optical light as well as to high energy x-rays.

* * * * *